US008697997B2

(12) United States Patent
Kelly et al.

(10) Patent No.: US 8,697,997 B2
(45) Date of Patent: Apr. 15, 2014

(54) CABLE WITH INTEGRATED CABLE-MANAGEMENT SYSTEM

(75) Inventors: Stephen Thomas Kelly, Redmond, WA (US); Ariel Braunstein, San Francisco, CA (US); Kyle Nathen Swen, San Carlos, CA (US); Greg P. McNamara, San Francisco, CA (US); Brian Patrick Bjelovuk, Cincinnati, OH (US)

(73) Assignee: Cisco Systems, Inc., San Jose, CA (US)

( * ) Notice: Subject to any disclaimer, the term of this patent is extended or adjusted under 35 U.S.C. 154(b) by 441 days.

(21) Appl. No.: 12/889,278

(22) Filed: Sep. 23, 2010

(65) Prior Publication Data

US 2012/0073857 A1 Mar. 29, 2012

(51) Int. Cl.
*H01B 7/02* (2006.01)

(52) U.S. Cl.
USPC ..... 174/115; 174/117 R

(58) Field of Classification Search
USPC ..... 174/115, 117 R
See application file for complete search history.

(56) References Cited

U.S. PATENT DOCUMENTS 2,528,667 A * 11/1950 Raabe ..... 343/866
4,230,898 A * 10/1980 Emmel ..... 174/32
4,847,443 A * 7/1989 Basconi ..... 174/32
5,113,036 A * 5/1992 Arroyo et al. ..... 385/100
6,111,202 A * 8/2000 Martin ..... 174/110 R
6,751,382 B2 * 6/2004 McGarvey ..... 385/102

OTHER PUBLICATIONS

Radhika Seth. "Line Up the Tangles", URL: http://www.yankodesign.com/2010/09/28/1ine-up-the-tangles/. dated Sep. 28, 2010.

Nosowitz, Dan, Tangle-Proof Headphone Deal Together Like a Ziploc, GIZMODO, Aug. 22, 2009, <http://gizmodo.com/5343401/tangle+proof-headphones-seal-together-like-a-ziploc>.

* cited by examiner

*Primary Examiner* — Chau Nguyen
(74) *Attorney, Agent, or Firm* — Patterson & Sheridan, LLP

(57) ABSTRACT

A cable has an integrated cable management system for organizing multiple cables. The body of the cable has a first mating surface with a first interlocking element disposed thereon and a second mating surface with a second interlocking element disposed thereon the second mating surface, where the first interlocking element is configured as a complementary interlocking element for the second interlocking element, so that multiple cables may be joined without the use of additional cable-organizing devices. The first interlocking element may include at least one coupling recess formed in the first mating surface and configured to engage with an interlocking element having the same configuration as the second interlocking element.

17 Claims, 4 Drawing Sheets

CABLE WITH INTEGRATED CABLE-MANAGEMENT SYSTEM

BACKGROUND OF THE INVENTION

1. Field of the Invention

Embodiments of the present invention relate generally to organizing data and power cables and more particularly, to a cable with an integrated cable-management system.

2. Description of the Related Art

Many electronic devices, such as computers, stereos, etc. require connection to one or more power and data cables. For example, the desktop computer typically has connections for a number of cables, including cables for video connections, one or more printers, a keyboard, a mouse, and any number of other peripheral devices. Thus, the number of cables employed can be fairly large and cumbersome even for this basic device. More sophisticated devices often have connections for even greater numbers of cables. A network router is one such device and may require the connection of tens or even hundreds of cables, each of which must be securely coupled to the proper connector.

In order to organize and manage large numbers of cables, many devices have been developed, but all have well-known drawbacks. For example, if installed too tightly, cable ties and other individual clamping devices can create pinch points, which are especially undesirable with high-frequency data cables. Such cable management systems can also be installed too loosely around a cable bundle, leaving the wrapped cables susceptible to movement and subsequent damage or dislocation. In addition, if maintenance of the cables is required or a single cable needs to be re-routed, each individual tying or clamping device must be removed and the entire cable bundle re-tied or re-clamped at each point, which can be time-consuming.

Accordingly, there is a need in the art for a device to organize cables in an improved fashion relative to prior art devices.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

For clarity, identical reference numbers have been used, where applicable, to designate identical elements that are common between figures. It is contemplated that features of any of the example embodiments may be incorporated in other embodiments without further recitation.

DETAILED DESCRIPTION

In the following description, numerous specific details are set forth to provide a more thorough understanding of various embodiments of the invention. However, it will be apparent to one of skill in the art that certain embodiments of the invention may be practiced without one or more of these specific details. In other instances, well-known features have not been described in order to avoid obscuring the invention.

Overview

One embodiment of the present invention sets forth an interlocking cable system that includes a cable body having a first mating surface and a second mating surface, a first interlocking element disposed on the first mating surface, and a second interlocking element disposed on the second mating surface that is configured as a complementary interlocking element for the first interlocking element.

Another embodiment of the present invention sets forth a cable management system that includes a cable body, a first mating surface disposed on the cable body, and a second mating surface disposed on the cable body that is configured to detachably engage a surface having a similar configuration as the first mating surface.

Yet another embodiment of the present invention sets forth an interlocking cable system that includes a first cable body having a first mating surface, and a first interlocking element disposed on the first mating surface and configured as a complementary interlocking element for a second interlocking element disposed on a second mating surface of a second cable body.

DESCRIPTION OF FIGURES

Figure 1:
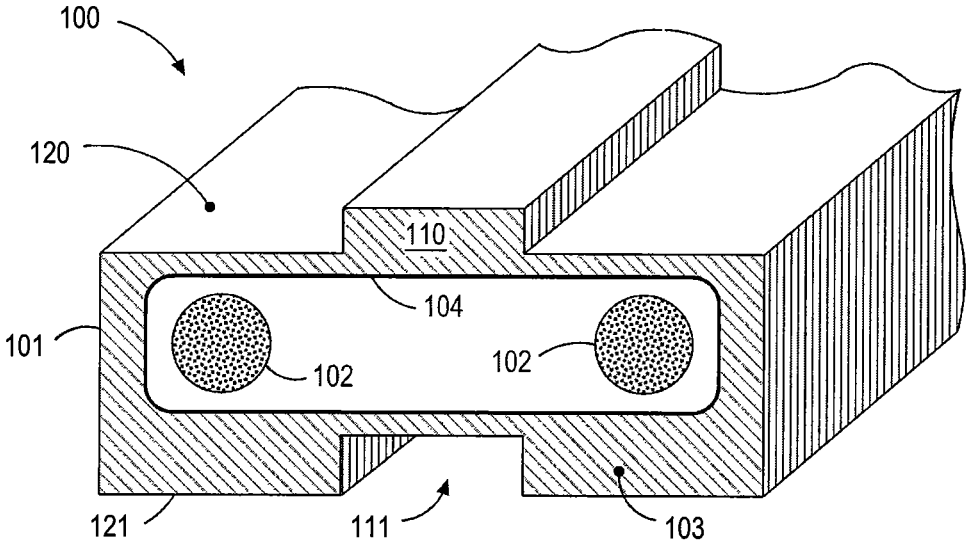
FIG. 1 schematically illustrates a perspective cross-sectional view of a cable, according to one example embodiment of the invention.

FIG. 1 schematically illustrates a perspective cross-sectional view of a cable 100, according to one embodiment of the invention. Cable 100 may be configured as a data cable, a power-delivering cable, or a combination of both, and includes a body 101 and suitable connectors (not shown) at each end. Examples of different configurations of cable 100 include an AC or DC power cable, an audio, video, and/or telephony signal cable, a cable for a mouse, keyboard, or other peripheral computer device, and a digital data cable, such as a SCSI, Category 5, or Category 6 cable. Body 101 includes one or more conductors 102, which may be signal- or power-delivering conductors, and an outer dielectric layer 103 (cross-hatched), that electrically insulates and protects conductors 102 from the surroundings. For clarity, FIG. 1 is illustrated with two conductors 102; however, cable 100 may include any desired combination of conductors. For example, conductors 102 may include one or more twisted pairs of wires, such as when cable 100 is configured as a networking cable. Depending on the intended application of cable 100, conductors 102 may be solid or braided, and of any suitable conductive material, such as copper, aluminum, silver, etc. In some embodiments, cable 100 may also include a shielding layer 104, which may comprise one or more alternating layers of conductive and/or dielectric materials and is configured to provide sufficient shielding of conductors 102 and from the surroundings and each other. The configuration and/or presence of shielding layer 104 depends on the specific application of cable 100.

Cable 100 further comprises at least one interlocking element 110 disposed on a mating surface 120 of body 101 and an interlocking element 111 disposed on a mating surface 121 of body 101. Interlocking element 110 may be a coupling tab, as shown, and may extend along the length of body 101 oriented substantially parallel to the longitudinal axis of body 101. Interlocking element 111 may be a coupling recess, such as a groove, that is configured to mechanically engage with an interlocking element having the same configuration as interlocking element 110. In some embodiments, interlocking elements 110, 111 are formed from outer dielectric layer 103, for example, by an extrusion process. Because surface 120 and surface 121 are disposed on substantially opposite sides of body 101, interlocking element 110 may be used to engage with a coupling recess disposed on a surface of a second cable, and interlocking element 111 may be used to engage with a coupling tab disposed on a surface of a third cable. Thus, a plurality of cables configured with interlocking elements 110, 111 may be advantageously joined together into a single cable bundle without the need for additional hardware or attachment devices. Two cables so attached are described below in conjunction with FIG. 2. Similarly, a single cable may be conveniently coiled upon and attached to itself, for example when a pig tail of the cable is required, without the need for additional cable-organizing devices, such as tie-wraps, etc. In addition, such cable-organizing devices do not need to be cut or removed when the cable is to be uncoiled, and instead the cable may simply be "unpeeled" from itself to remove the coil.

Figure 2:
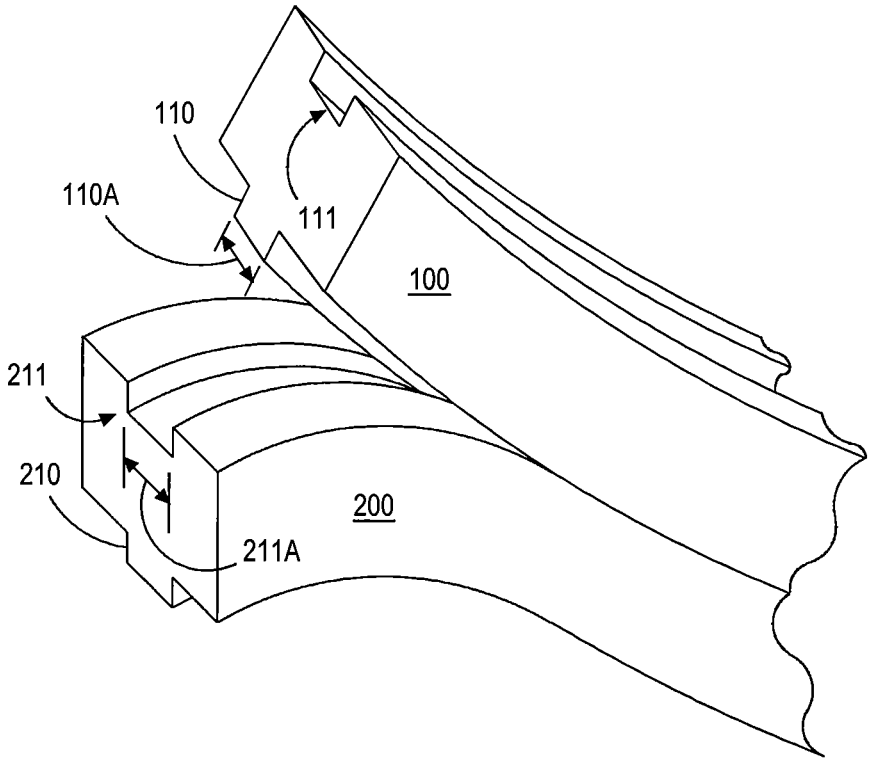
FIG. 2 schematically illustrates a perspective cross-sectional view of a cable partially joined to a second cable, according to one example embodiment of the invention.

FIG. 2 schematically illustrates a perspective cross-sectional view of cable 100 partially joined to a second cable 200, according to one embodiment of the invention. Second cable 200 is configured substantially similar to cable 100 and includes interlocking elements 210, 211. Cable 100 and cable 200 are mechanically engaged by the insertion of interlocking element 110, which is illustrated as a coupling tab, into interlocking element 211, which is illustrated as a coupling groove. In some embodiments, the mechanical coupling between interlocking element 110 and interlocking element 211 occurs due to mechanical interference between interlocking element 110 and interlocking element 211 and the elasticity of the material from which interlocking element 110 and interlocking element 211 are formed. Specifically, interlocking element 110 may be configured with a width 110A that is slightly larger than the width 211A of interlocking element 211, so that the elasticity of interlocking element 110 and interlocking element 211 mechanically couples cable 100 to cable 200. Suitable mechanical interference between width 110A and width 211A depends on a number of factors, including the elasticity of the material from which interlocking element 110 and interlocking element 211 are formed, the number of interlocking elements disposed on the mating surfaces of each cable, and the desired force required to join and separate cables 100 and 200.

In FIGS. 1 and 2, interlocking element 110 is illustrated as a coupling tab that is substantially rectangular in cross-section. In alternative embodiments, the cross-sectional profile of interlocking elements 111 may be other shapes than rectangular, e.g., semi-circular, as long as interlocking elements 110, 111 are both configured in substantially the same way and therefore mechanically engage with a complementary interlocking element on an adjacent cable.

Figure 3:
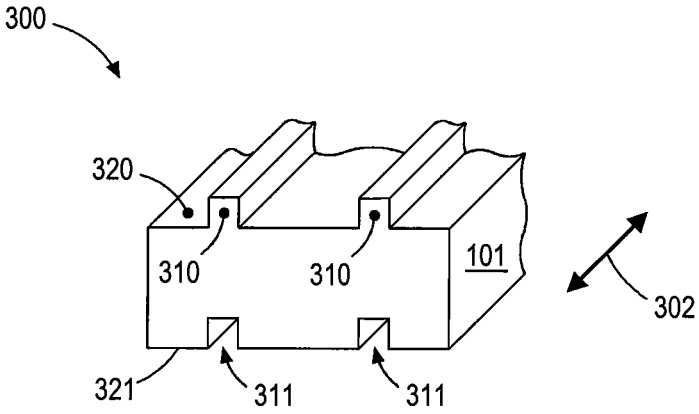
FIG. 3 schematically illustrates a perspective cross-sectional view of a cable with multiple interlocking elements disposed on mating surfaces, according to one example embodiment of the invention.

For a more robust connection between cables joined in a single cable bundle, according to other embodiments of the invention, the mechanical engagement between such cables is enhanced using multiple interlocking elements on the mating surfaces of said cables. FIG. 3 schematically illustrates a perspective cross-sectional view of a cable 300 with multiple interlocking elements disposed on mating surfaces 320 and 321, according to one embodiment of the invention. Cable 300 is substantially similar in configuration to cable 100, except that mating surface 320 includes two or more interlocking elements 310 and mating surface 321 includes an equal number of complementary interlocking elements 311. In FIG. 3, interlocking elements 310 are illustrated as coupling tabs, as shown, and may extend along the length of body 101 oriented substantially parallel to the longitudinal axis 302 of body 101. Interlocking elements 311 may be coupling recesses, such as grooves, that are configured to mechanically engage with an interlocking element having the same configuration as interlocking element 310.

Figure 4:
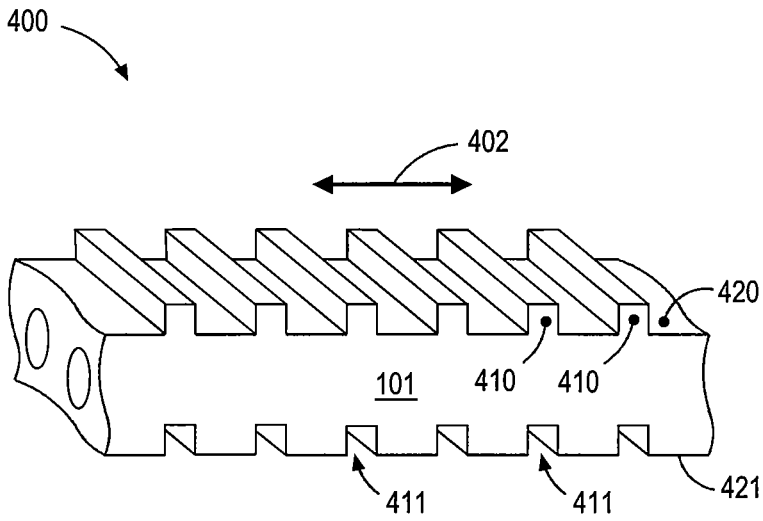
FIG. 4 illustrates a plurality of interlocking elements formed on a mating surface of a cable, where the plurality of interlocking elements are oriented substantially transverse to the longitudinal axis of the body, according to one example embodiment of the invention.

In FIGS. 1-3, the complementary interlocking elements disposed on the mating surfaces of cables 100, 200, and 300 are illustrated as oriented substantially parallel to the longitudinal axis of the body of each cable. Other configurations of complementary interlocking elements may also be employed without departing from the scope of the invention. In some embodiments, a plurality of interlocking elements, such as coupling recesses, may be formed on a mating surface of a cable, where the plurality of interlocking elements are oriented substantially transverse to the longitudinal axis of the body. FIG. 4 illustrates one such embodiment. Cable 400 is substantially similar in configuration to cable 100, except that mating surface 420 includes a plurality of interlocking elements 410 and mating surface 421 includes an equal number of complementary interlocking elements 411. As shown, interlocking elements 410 are illustrated as coupling tabs oriented substantially transverse to, although not necessarily perpendicular to, the longitudinal axis 402 of body 101 and may extend along substantially the entire length of body 101. Similarly, interlocking elements 411 are illustrated as coupling grooves oriented substantially transverse to the longitudinal axis of body 101 and may extend along substantially the entire length of body 101. Interlocking elements 410 are configured to mechanically engage with interlocking elements having the same configuration as interlocking elements 411 and vice-versa.

Figure 5:
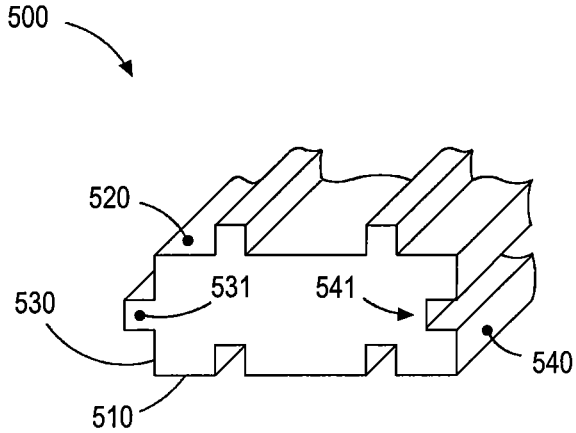
FIG. 5 schematically illustrates a perspective cross-sectional view of an exemplary embodiment of a cable with mating surfaces on more than just two opposite sides, according to one example embodiment of the invention.

Cables configured with mating surfaces on two opposite sides, such as cables 100, 200, 300, and 400, may be stacked to form a substantially one-dimensional cable bundle, an example of which is illustrated in FIG. 2. According to embodiments of the invention, cables may also be configured with mating surfaces on more that two sides to allow the formation of a two-dimensional cable bundle. FIG. 5 schematically illustrates a perspective cross-sectional view of an exemplary embodiment of a cable 500 with mating surfaces on more than just two opposite sides. Cable 500 is substantially similar in configuration to cable 100, except cable 500 includes more than two mating surfaces disposed on opposite sides of body 101. In the embodiment of FIG. 5, cable 500 is substantially rectangular in cross-section and includes two pairs of opposing mated surfaces, i.e., mating surfaces 510, 520 and mating surfaces 530, 540. Because mating surface 530 includes interlocking element 531 and mating surface 540 includes interlocking element 541, cables with similar configuration to cable 500 may be joined to any of mating surfaces 510, 520, 530, or 540. Consequently, a two-dimensional cable bundle may be formed that can be more compact than a one-dimensional cable bundle in some applications.

Figure 6:
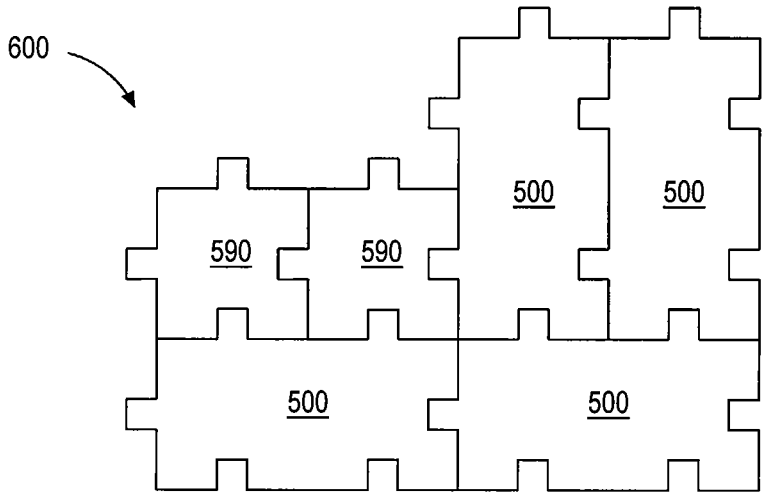
FIG. 6 schematically illustrates a two-dimensional cable bundle with complementary interlocking elements disposed on more than two sides that may be assembled from a plurality of cables configured, according to one example embodiment of the invention.

FIG. 6 schematically illustrates a two-dimensional cable bundle 600 with complementary interlocking elements disposed on more than two sides that may be assembled from a plurality of cables configured, according to one embodiment of the invention. As shown, not all cables have to be necessarily be identical in configuration to benefit from such an embodiment. Two-dimensional cable bundle 600 may include square cables, such as cable 500, and rectangular cables, such as cables 590. It is noted that, although a plurality of cables are joined together to form two-dimensional cable bundle 600, two-dimensional cable bundle 600 can be arranged so that each and every cable is still visible and visual tracing of cable routing is not hindered.

Figure 7:
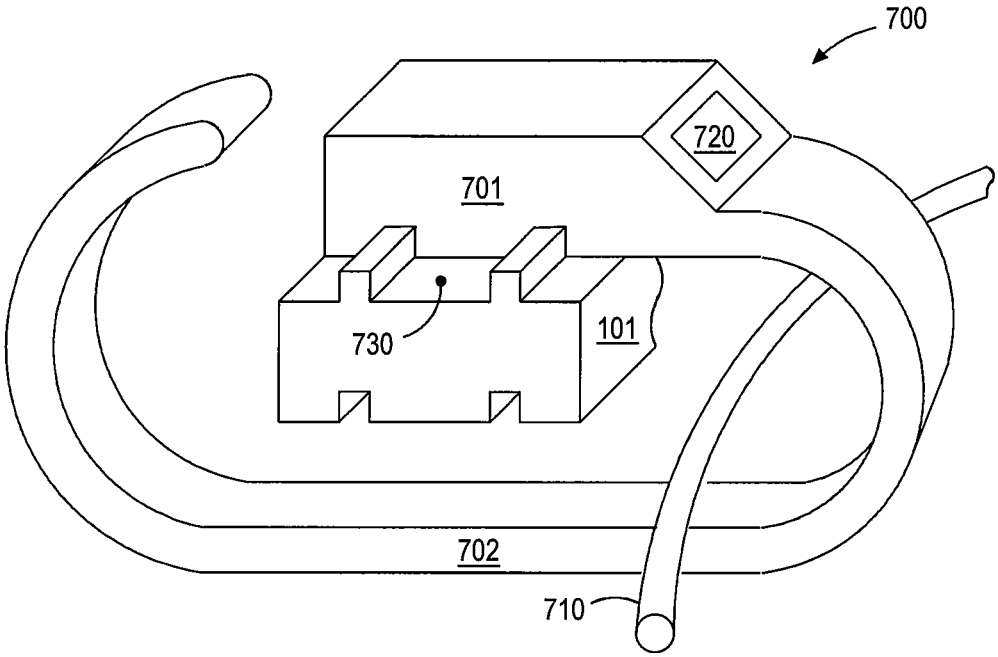
FIG. 7 illustrates a cable with an attachment element, according to one example embodiment of the invention.

In some embodiments, a cable has an attachment element for including cables in a cable bundle that do not conform to the cable-bundling systems previously detailed herein. FIG. 7 illustrates a cable 700 with an attachment element 701, according to one embodiment of the invention. Attachment element 701 is configured to join cables without suitable interlocking elements to cable 700, e.g., a non-conforming cable 710. Attachment element 701 may include a cable-collecting element 702 configured to attach non-conforming cable 710 to cable 700. Cable collecting element 702 may be a flexible member having suitable length and elastic properties to wrap around one or more non-conforming cables 710, as shown, and be fed through opening 720. Alternatively, attachment element 701 may include a cable-mounting element configured to serve as a mounting point for cable 700 to be fixed to an external surface, such as a wall, etc. The cable-mounting element may include an attachment fixture, such as a screw hole or double-sided tape surface, etc. In some embodiments, attachment element 701 may be joined to a mating surface 730 of cable 700 using the same configuration of interlocking elements used to join a cable to mating surface 730. In other embodiments, attachment element 701 may be an integral part of cable 700.

In some embodiments, color-coding may be used for different types of cables to make tracing the routing of each cable or cable type in a particular cable bundle easier. Thus, when re-routing cables, a particular cable having a specific color may be easily traced, even though the cable is joined in a cable bundle of multiple cables. And, because the interlocking elements that join each cable are readily separated without specialized tools, a cable bundle may be quickly modified by splitting the cable bundle at the desired cable, removing and/or replacing the desired cable, and reassembling the cable bundle by joining two mating cable surfaces.

In sum, embodiments of the invention provide a cable with an integrated cable management system that organizes cables for a number of applications. In some embodiments, cables can be readily joined and detached to form cable bundles as desired while maintaining visibility of each and every cable contained in the cable bundle. No additional cable-organizing devices are needed—even when including cables in a cable bundle that are not configured with suitable mating surfaces. In addition, a cable can be separated from the cable bundle at any point without having to completely re-organize the entire cable bundle.

While the foregoing is directed to embodiments of the present invention, other and further embodiments of the invention may be devised without departing from the basic scope thereof, and the scope thereof is determined by the claims that follow

We claim:

1. An interlocking cable system, comprising:

a cable body having a substantially rectangular cross-section, the cable body comprising a first mating surface on a first side, a second mating surface on a second side, a third mating surface on a third side, and a fourth mating surface on a fourth side;

a first interlocking element disposed on the first mating surface;

a second interlocking element disposed on the second mating surface that is configured as a complementary interlocking element for the first interlocking element, wherein the first mating surface is disposed substantially opposite the second mating surface;

a third interlocking element disposed on the third mating surface; and a fourth interlocking element disposed on the fourth mating surface that is configured as a complementary interlocking element for the first interlocking element, wherein the third mating surface is disposed substantially opposite the fourth mating surface.

2. The cable of claim 1, wherein the first interlocking element includes at least one coupling recess that is formed in the first mating surface and is configured to engage with an interlocking element having a similar configuration as the second interlocking element, and wherein the third interlocking element includes at least one coupling recess that is formed in the third mating surface and is configured to engage with an interlocking element having a similar configuration as the fourth interlocking element.

3. The cable of claim 2, wherein the second interlocking element includes at least one coupling tab that extends from the second mating surface and is configured to engage with a coupling recess having a similar configuration as the coupling recess formed in the first mating surface.

4. The cable of claim 2, wherein the at least one coupling recess comprises a coupling groove.

5. The cable of claim 4, wherein the coupling groove is oriented substantially parallel to a longitudinal axis of the cable body.

6. The cable of claim 1, wherein the second interlocking element includes at least one coupling tab that extends from the second mating surface and is configured to engage with an interlocking element having a similar configuration as the first interlocking element.

7. The cable of claim 1, wherein the first interlocking element includes a plurality of coupling recesses formed in the first mating surface and configured to engage with an interlocking element having a similar configuration as the second interlocking element.

8. The cable of claim 1, further comprising an outer dielectric layer in which the first interlocking element and the second interlocking element are formed.

9. The cable of claim 1, further comprising an attachment element disposed on the cable body.

10. The cable of claim 9, wherein the attachment element is detachably fixed to either the first mating surface or the second mating surface by a fifth interlocking element that is configured to engage with either the first interlocking element or the second interlocking element, and is disposed on a surface of the attachment element.

11. The cable of claim 10, wherein the attachment element comprises a cable-collecting element configured to couple one or more additional cables to the cable.

12. The cable of claim 9, wherein the attachment element comprises a cable-mounting element that is configured as a mounting point for fixing the cable to an external surface.

13. The cable of claim 1, wherein the first interlocking element includes at least one coupling recess that is formed in the first mating surface and is configured to engage with an interlocking element having a similar configuration as the second interlocking element, and wherein the third interlocking element includes at least one coupling recess that is formed in the third mating surface and is configured to engage with an interlocking element having a similar configuration as the fourth interlocking element.

14. The cable of claim 13, wherein the first and third interlocking elements each comprise of a plurality of coupling recesses extending substantially parallel to a longitudinal axis of the cable body, and wherein the second and fourth interlocking elements each comprise of a plurality of tabs coupling tab extending substantially parallel to a longitudinal axis of the cable body and configured to engage with coupling recesses having a similar configuration as the plurality of coupling recesses of the first and third interlocking elements.

15. An interlocking cable system, comprising:

a cable body having a substantially rectangular cross-section, the cable body comprising a first mating surface on a first side, a second mating surface on a second side, a third mating surface on a third side, and a fourth mating surface on a fourth side;

a first interlocking element disposed on the first mating surface;

a second interlocking element disposed on the second mating surface that is configured as a complementary interlocking element for the first interlocking element, wherein the first interlocking element includes a plurality of coupling recesses formed in the first mating surface and configured to engage with an interlocking element having a similar configuration as the second interlocking element, wherein the plurality of coupling recesses is oriented substantially transverse to a longitudinal axis of the cable body;

a third interlocking element disposed on the third mating surface; and a fourth interlocking element disposed on the fourth mating surface that is configured as a complementary interlocking element for the first interlocking element.

16. An interlocking cable system, comprising:

a cable body having a substantially rectangular cross-section, the cable body comprising a first mating surface on a first side, a second mating surface on a second side, a third mating surface on a third side, and a fourth mating surface on a fourth side;

a first interlocking element disposed on the first mating surface;

a second interlocking element disposed on the second mating surface that is configured as a complementary interlocking element for the first interlocking element, wherein the first interlocking element includes a plurality of coupling recesses formed in the first mating surface and configured to engage with an interlocking element having a similar configuration as the second interlocking element, wherein the second interlocking element includes a plurality of coupling tabs extending from the second mating surface and configured to engage with a plurality of coupling recesses having a similar configuration as the coupling recesses formed in the first mating surface;

a third interlocking element disposed on the third mating surface; and a fourth interlocking element disposed on the fourth mating surface that is configured as a complementary interlocking element for the first interlocking element.

17. An interlocking cable system, comprising:

a first cable body having a substantially rectangular cross-section, the first cable body comprising:

a first mating surface on a first side and a second mating surface on a second side, a first interlocking element disposed on the first mating surface, and a second interlocking element disposed on the second mating surface that is configured as a complementary interlocking element for the first interlocking element;

a second cable body having a substantially rectangular cross-section, the second cable body comprising:

a third mating surface on a third side and a fourth mating surface on a fourth side, a third interlocking element disposed on the third mating surface, a fourth interlocking element disposed on the fourth mating surface and coupled to the first interlocking element on the first mating surface of the first cable body; and a third cable body having a substantially rectangular cross-section, the third cable body comprising:

a fifth mating surface on a fifth side and a sixth mating surface on a sixth side, a fifth interlocking element disposed on the fifth mating surface and coupled to the second interlocking element on the second mating surface of the first cable body, and a sixth interlocking element disposed on the sixth mating surface and coupled to the third interlocking element on the third mating surface of the second cable body.

* * * * *